US006977622B2

(12) United States Patent
Hay et al.

(10) Patent No.: US 6,977,622 B2
(45) Date of Patent: Dec. 20, 2005

(54) SHAPED-REFLECTOR MULTIBEAM ANTENNAS

(75) Inventors: Stuart Gifford Hay, Kogarah Bay (AU); Christophe Jean-Marc Granet, Ryde (AU); Trevor Stanley Bird, Eastwood (AU); Mark Andrew Sprey, Lindfield (AU); Stephen John Barker, North Ryde (AU); Anthony Ross Forsyth, Mount Colah (AU)

(73) Assignee: Commonwealth Scientific and Industrial Research Organisation, Campbell (AU)

( * ) Notice: Subject to any disclaimer, the term of this patent is extended or adjusted under 35 U.S.C. 154(b) by 17 days.

(21) Appl. No.: 10/666,231

(22) Filed: Sep. 18, 2003

(65) Prior Publication Data

US 2004/0108961 A1 Jun. 10, 2004

(30) Foreign Application Priority Data

Oct. 1, 2002 (AU) ..... 2002951799

(51) Int. Cl.[7] ..... H01Q 13/00

(52) U.S. Cl. ..... 343/781 P; 343/781 CA; 343/837

(58) Field of Search ..... 343/781 R, 781 P, 343/781 CA, 836, 837, 840

(56) References Cited

U.S. PATENT DOCUMENTS

| | | | | |
|---|---|---|---|---|
| 4,298,877 A | | 11/1981 | Sletten | |
| 4,755,826 A | * | 7/1988 | Rao | 343/781 P |
| 4,757,325 A | * | 7/1988 | Thompson et al. | 343/781 R |
| 5,160,937 A | * | 11/1992 | Fairlie et al. | 343/781 P |
| 5,790,077 A | * | 8/1998 | Luh et al. | 343/781 P |

OTHER PUBLICATIONS

Clarricoats, P.J.B. and Poulton, G.T., "High–efficiency microwave reflector antennas–A review", Proceedings of the IEEE, 1977, vol. 65, pp. 1470–1504.

Bird, T.S., "Contoured–beam synthesis for array–fed reflector antennas by field correlation", IEE Proceedings, Part H, 1982, vol. 129, No. 6, pp. 293–298.

James, G.L., "Geometrical theory of diffraction for electromagnetic waves", Peter Peregrinus Ltd, London, 1986.

Weatherburn, C.E., "Differential geometry of three dimensions", Cambridge University Press, 1961.

Rahmat–Samii Y et al.: "Modern antenna design concepts for satellite and personal communications". Aerospace Applications Conference, 1994, Proceedings., 1994 IEEE, Vail, Co, USA Feb. 5–12,1994, New York, NY, USA, IEEE, Feb. 5, 1994, pp. 343–353, XP01020969, ISBN: 0–7803–1831–5, * page 343–page 345*.

(Continued)

*Primary Examiner*—Hoang V. Nguyen
(74) *Attorney, Agent, or Firm*—Kenyon & Kenyon

(57) ABSTRACT

A method, an apparatus, and a computer program product for electromagnetically designing a shaped-reflector multibeam antenna (100) are disclosed. An initial configuration of the multibeam antenna (100) for given beam directions is provided of reflectors (110,120) shaped with an initial reflector shaping process (612) and feeds of an initial specification (614). The initial reflector shaping process (612) is an iterative optimization process for increasing the focusing of optical rays incident on the multibeam antenna from the given beam directions (100). A second iterative optimizing process consisting of optimizing (620) radiation patterns of feeds (140A–140D) and optimizing (622) surface shapes and sizes of reflectors (110,120) is used to reduce beam spillover, improve beam shapes and obtain beams with gain radiation patterns within required upper and lower bounds.

46 Claims, 9 Drawing Sheets

OTHER PUBLICATIONS

"Manual for POS: Physical optics single reflector shaping program". Feb. 1991, Ticra Engineering Consultants, Copenhagen, Denmark, XP002274567, * paragraphs [4.1.4], [4.1.5]*.

N.C. Albertsen, K. Pontoppidan, S.B. Sörensen: "Shaping of dual reflector antennas for improvement of scan performance". AP–S International Symposium on Antennas and Propagation, vol. 1, Jun. 17, 1985, –pp. 357–360, XP002274566, Vancouver, BC, Canada. * the whole document*.

Aoki K et al: "Design method for offset shaped dual–reflector antenna with an elliptical aperture of low–cross–polarisation characteristics". IEE Proceedings: Microwaves, Antennas and Propagation, IEE, Stevenage, Herts, GB, vol. 146, No. 1, Feb. 9, 1999 pp. 60–64, XP006013532. ISSN: 1350–2417. section 3; * figure 3*.

Hay, S.G., "Subreflector shaping to improve the multiple–beam performance of Cassegrain antennas", Electronics Letters, 1987, vol. 23, No. 15, pp. 789–791.

Hay, S.G., "Offset dual–reflector multiple–beam antennas using circularly symmetric main reflectors", Electronics Letters, 1987, vol. 23, No. 17, pp. 888–890.

Bird, T.S. and Sprey, M.A., "Scan limitations of shaped dual–reflector antennas for multiple satellite access", Electronics Letters, 1990, vol. 26, No. 4, pp. 228–230.

Clarricoats, P.J.B. and Oliver, A.D., "Corrugated horns for microwave antennas", Peter Peregrinus Ltd, London, 1984.

Pontoppidan, K., "Technical description of GRASP7 and GRASPC", TICRA Engineering Consultants, S–359–03, 1993.

Bird, T.S. and James. G.L., "Design and Practice of Reflector Antennas and Feed Systems in the 1990s"Review of Radio Science 1996–1999, U.R.S.I., Oxford Science Publications, pp. 81–117.

James, G.C., Bird, T.S., Hay, S.G., Cooray, F.R. and Granet, C., "A hybrid method of analysing reflector and feed antennas for satellite applications", Proc. 2000 Int. Symposium on Antennas & Propagat., Fukuoka, Japan, 21–25 Aug. 2000, pp. 49–52.

James, G.L., "Analysis of radiation pattern and G/T for shaped dual–reflector antennas", IEE Proceedings, Part H, 1980, vol. 127, No. 1, pp. 52–53.

Sletten, C.J. and Carrillo, S.E., "Scanning multibeam communication antennas", IEEE Antennas and Propagation Society International Symposium, 1984, pp. 474–477.

Granet, C., and Bird, T.S., "Optimization of corrugated horn radiation patterns via a spline–profile", ANTEM 2002, $9^{th}$ International Symposium on Antenna Technology and Applied Electromagnetics, Montreal, Canada, 2002, pp. 307–310.

Hay, S.G., "Program DRASYS", Esoft, CSIRO Division of Radiophysics, 1992, Australia.

Granet, C., James, G.L. and Pezzani, J., "A new dual–reflector feed system for the Nancay radiotelescope", IEEE Transactions on Antennas and Propagation , 1997, vol. 45, pp. 1366–1373.

Wood, P.J., "Reflector antenna analysis and design", Peter Peregrinus Ltd, London, 1980, pp. 86–93

Westcott B S et al: "Dual–reflector synthesis based on analytical gradient–iteration procedures". IEE Proceedings: Microwaves, Antennas and Propagation, IEE, Stevenage, Herts, GB, vol. 142, No. 2, Apr. 1, 1995, pp. 129–35, XP006004221, ISSN: 1350–2417. section 3.

Duan D–W et al: "A Generalized Diffraction Synthesis Technique for High Performace Reflector Antennas", IEEE Transactions on Antennas and Propagation, IEEE Inc. New York, US, vol. 43, No. 1, 1995, pp. 27–40, XP000491303. ISSN: 0018–926X. * figure 1*.

* cited by examiner

SHAPED-REFLECTOR MULTIBEAM ANTENNAS

FIELD OF THE INVENTION

The present invention relates generally to an antenna and, in particular, to the design of shaped-reflector multibeam antennas.

BACKGROUND

An antenna that can produce independent beams in various directions, whilst the beams overlap on, or reuse, surfaces in the antenna has long been a goal of antenna research for a range of applications. One class of antenna of study in this regard is the reflector antenna with an array of feeds, where one feed is used for each beam. Such antennas can generate beams of high gain and low sidelobes within a limited range of directions. Considerable work has been undertaken in determining the multibeam capabilities of particular reflector configurations and in optimizing the sizes and shapes of reflector surfaces for desired sets of beams.

U.S. Pat. No. 4,298,877 issued to Sletten, C. J. on 3 Nov. 1981 and entitled "Offset-fed multibeam tracking system utilizing especially shaped reflector surfaces" describes a reflector-shaping process. This reflector-shaping process refers only to two beam directions. The antenna uses two separate subreflectors, one for each of the beams, and the beam directions are in the same plane as the feed and subreflector offsets. In the shaping procedure, the main reflector and one of subreflectors are first shaped to obtain an aperture distribution with uniform phase, low radiation-pattern sidelobes and maximum aperture efficiency or beam gain. The second subreflector is then shaped as a phase-correcting subreflector for producing the second beam. This procedure produces more than two beams without modification to the shapes of the reflector surfaces, by placing additional feeds in the focal regions of the two subreflectors. However, this approach disadvantageously results in greatly inferior performance in a desired application where a large number of beams and a large beam-direction range are required. In particular, maximum gain rapidly decreases, and sidelobes rapidly increase as additional feeds are added, because the reflector surfaces are not shaped to maximize the performance of all beams.

SUMMARY

In accordance with a first aspect of the invention, there is provided a method of electromagnetically designing a shaped-reflector multibeam antenna. The method comprises the steps of: providing an initial configuration of reflectors shaped with a reflector shaping process and feeds for the multibeam antenna for given beam directions, the reflector shaping process being an iterative optimization process for increasing the focusing of optical rays incident on the multibeam antenna from the given beam directions; optimizing the radiation patterns of the feeds; and optimizing the surface shapes and sizes of the reflectors of the multibeam antenna. The latter optimizing steps are iterative processes for achieving required upper and lower bounds for the gain radiation patterns of the beams of the multibeam antenna, and may be performed in one or more iterations.

Preferably, the reflectors are a pair, one reflector called a primary or main reflector being illuminated by a second reflector or subreflector which is illuminated by the feeds.

Preferably, the providing step comprises the steps of: determining requirements for beam directions and gain radiation patterns; specifying reflectors and applying initial reflector-shaping process; specifying feeds having a nominal design; placing feeds at focal points; and calculating gain radiation patterns of beams of multibeam antenna, using the methods of physical optics or the geometrical or physical theories of diffraction.

Preferably, the optimizing step for radiation patterns of feeds comprises shaping of the radiation patterns of the feeds to decrease spillover of the beams at one or more of the reflectors of the multibeam antenna.

Preferably, the optimizing step for radiation patterns of feeds comprises shaping radiation patterns of feeds to compensate for distorting effects of reflectors on shapes of beams or to increase rotational symmetry of the beams at one or more reflectors of the multibeam antenna.

Preferably, the optimizing step for reflector surface shapes and sizes comprises optimizing reflectors to increase rotational symmetry or decrease spillover of beams at one or more of the reflectors of the multibeam antenna.

Preferably, the optimizing steps comprise representing the sizes or shapes of the feeds or reflectors in terms of a set of variable parameters and optimizing one or more of these parameters.

Preferably, the optimizing steps involve performing a gradient search for reflector and feed parameters that minimize a weighted sum of gain radiation pattern errors in regard to required upper and lower bounds for gain radiation patterns of the beams of the multibeam antenna.

Preferably, the optimizing steps comprise calculating the gain radiation patterns of the beams of the multibeam antenna, using the methods of physical optics or the geometrical or physical theories of diffraction.

In accordance with a second aspect of the invention, there is provided an apparatus for electromagnetically designing a shaped-reflector multibeam antenna. The apparatus comprises: a device for providing an initial configuration of reflectors shaped with a reflector shaping process and feeds for the multibeam antenna for given beam directions, the reflector shaping process being an iterative optimization process for increasing the focusing of the optical rays incident on the multibeam antenna from the given beam directions; a device for optimizing the radiation patterns of the feeds for the multibeam antenna; and a device for optimizing the surface shapes and sizes of the reflectors of the multibeam antenna. The latter optimizing steps are iterative optimization process for achieving required upper and lower bounds for the gain radiation patterns of the multibeam antenna.

In accordance with a third aspect of the invention, there is provided a computer program product having a computer readable medium having a program recorded therein for electromagnetically designing a shaped-reflector multibeam antenna. The computer program product comprises a computer program code module for providing an initial configuration of reflectors shaped with a reflector shaping process and feeds for the multibeam antenna for given beam directions, the reflector shaping process being an iterative optimization process for increasing the focusing of the optical rays incident on the multibeam antenna from the given beam directions; a computer program code module for optimizing the radiation patterns of the feeds for the multibeam antenna; and a computer program code module for optimizing the surface shapes and sizes of the reflectors of the multibeam antenna. The latter optimizing steps are iterative optimization process for achieving required upper and lower bounds for the gain radiation patterns of the multibeam antenna.

BRIEF DESCRIPTION OF THE DRAWINGS

Embodiments of the invention are described hereinafter with reference to drawings, in which.

DETAILED DESCRIPTION

A method, an apparatus, and a computer program product for electromagnetically designing shaped-reflector multibeam antennas are disclosed. In the following description, numerous specific details are set forth. However, in the light of this disclosure, it will be apparent to a person skilled in the art that changes may be made to the embodiments without departing from the scope and spirit of the invention. In particular, the method, the apparatus, and the computer program product seek to minimize sidelobes and reduce spillover, especially spillover behind the main reflector, and thereby improve overall performance of a multibeam antenna. This results in better control of the symmetry, focusing and radiation patterns of the beams.

1. Introduction

The design goals for shaped-reflector multibeam antennas comprise more beams and more demanding radiation-pattern requirements than previously considered. This has resulted in new antenna performance, greater knowledge of the radiation-pattern properties of this class of antenna and improved design techniques.

Figure 9:
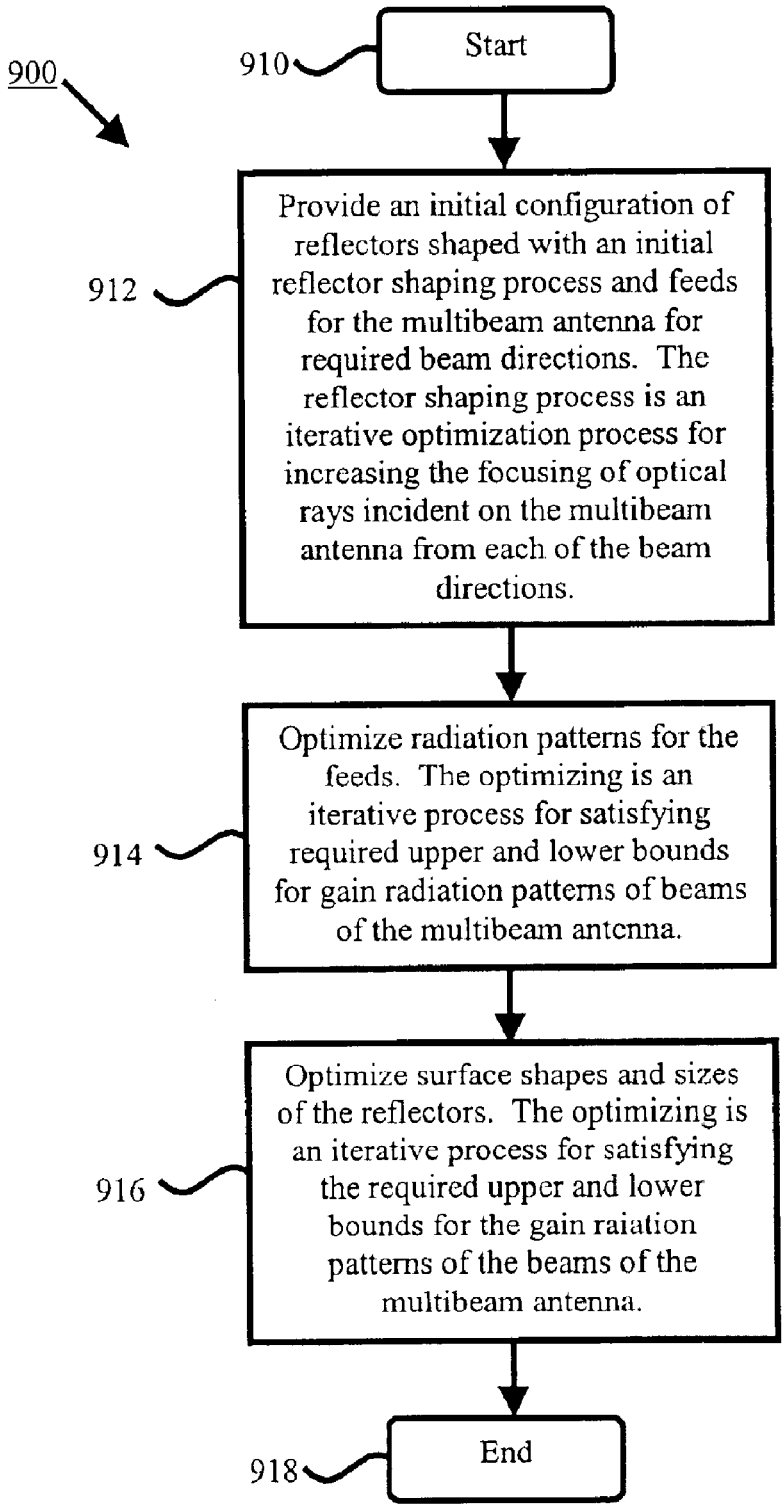
FIG. 9 is a flow diagram of a method of electromagnetically designing a shaped-reflector multibeam antenna.

FIG. 9 is a flow diagram of a method 900 of electromagnetically designing a shaped-reflector multibeam antenna. Processing commences in step 910. In step 912, there is provided an initial configuration of reflectors shaped with a reflector shaping process and feeds for the multibeam antenna for given beam directions. The reflector shaping process is an iterative optimization process for increasing the focusing of optical rays incident on the multibeam antenna from the given beam directions. In step 914, the radiation patterns of the feeds are optimized. In step 916, the surface shapes and sizes of the reflectors of the multibeam antenna are optimised. The optimizing steps 914 and 916 are iterative processes for achieving required upper and lower bounds for the gain radiation patterns of the beams of the multibeam antenna, and may be performed in one or more iterations. Processing terminates in step 918. Further details of this method 900 are set forth hereinafter.

2. Antenna and Application Concepts

Figure 1:
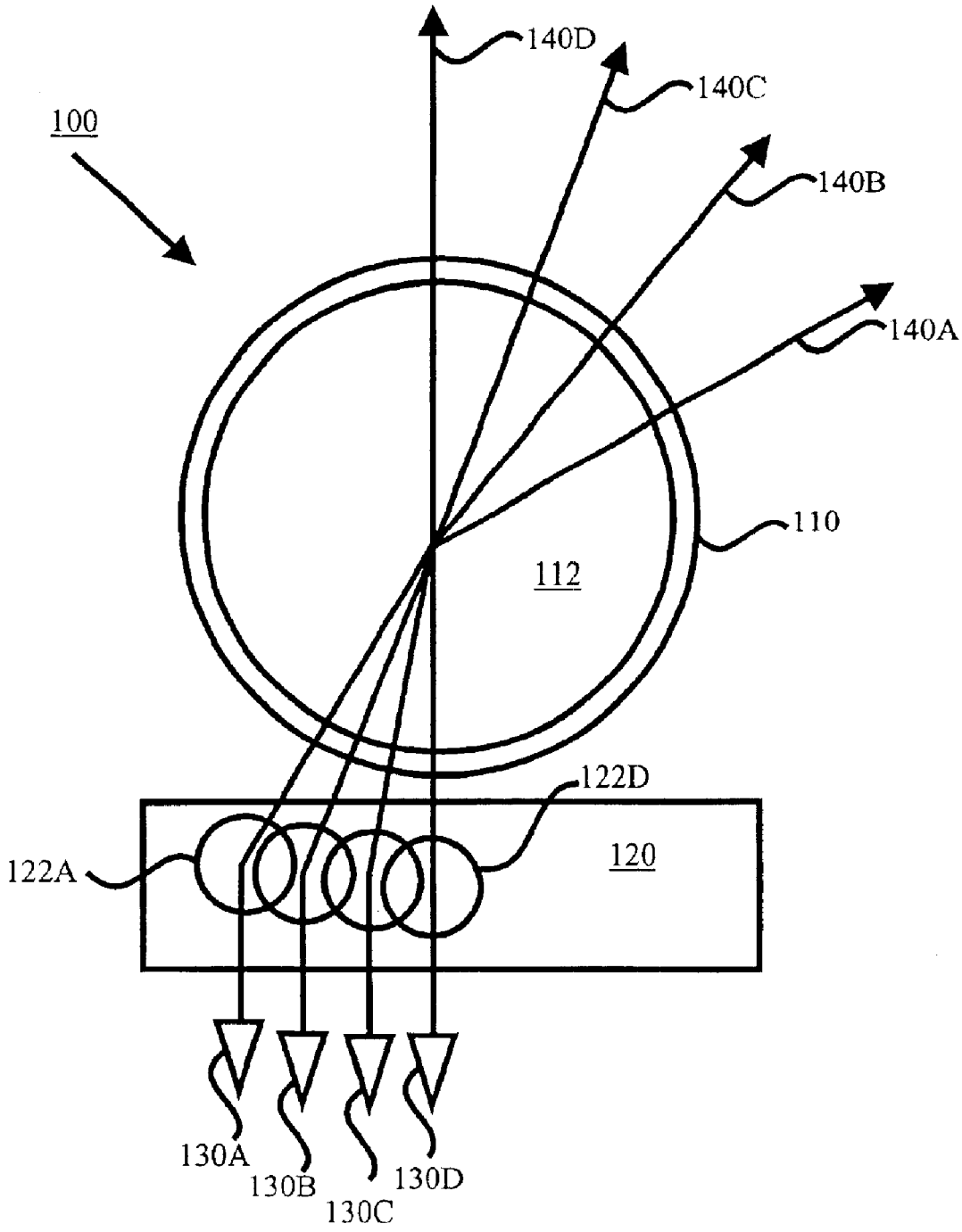
FIG. 1 is a block diagram of a dual-reflector multibeam antenna with which embodiments of the invention may be practiced.

FIG. 1 illustrates a dual-reflector multibeam antenna 100 with a number of feeds 130A–130D, each generating a corresponding beam 140A–140D. All four beams 140A–140D use most of the surface 112 of a main reflector 110 and neighbouring beams overlap partially 122A–122D at the surface of a subreflector 120. The size of the overlap 122A–122D increases as the range of beam directions increases. While four beams are depicted in FIG. 1, it will be apparent to those skilled in the art in view of this disclosure that other numbers of beams may be practiced.

For the production of multiple beams within a large one-dimensional region of beam directions, in particular for earth-based access to communications satellites along a contiguous section of the geostationary arc, an embodiment of the invention uses the compact configuration illustrated in FIG. 1. In FIG. 1, the directions of the beams 140A–140D lie in a plane orthogonal to the direction of offset of the subreflector 120 from the main-beam axes.

3. Initial Configuration and Its Limitations

Figure 6:
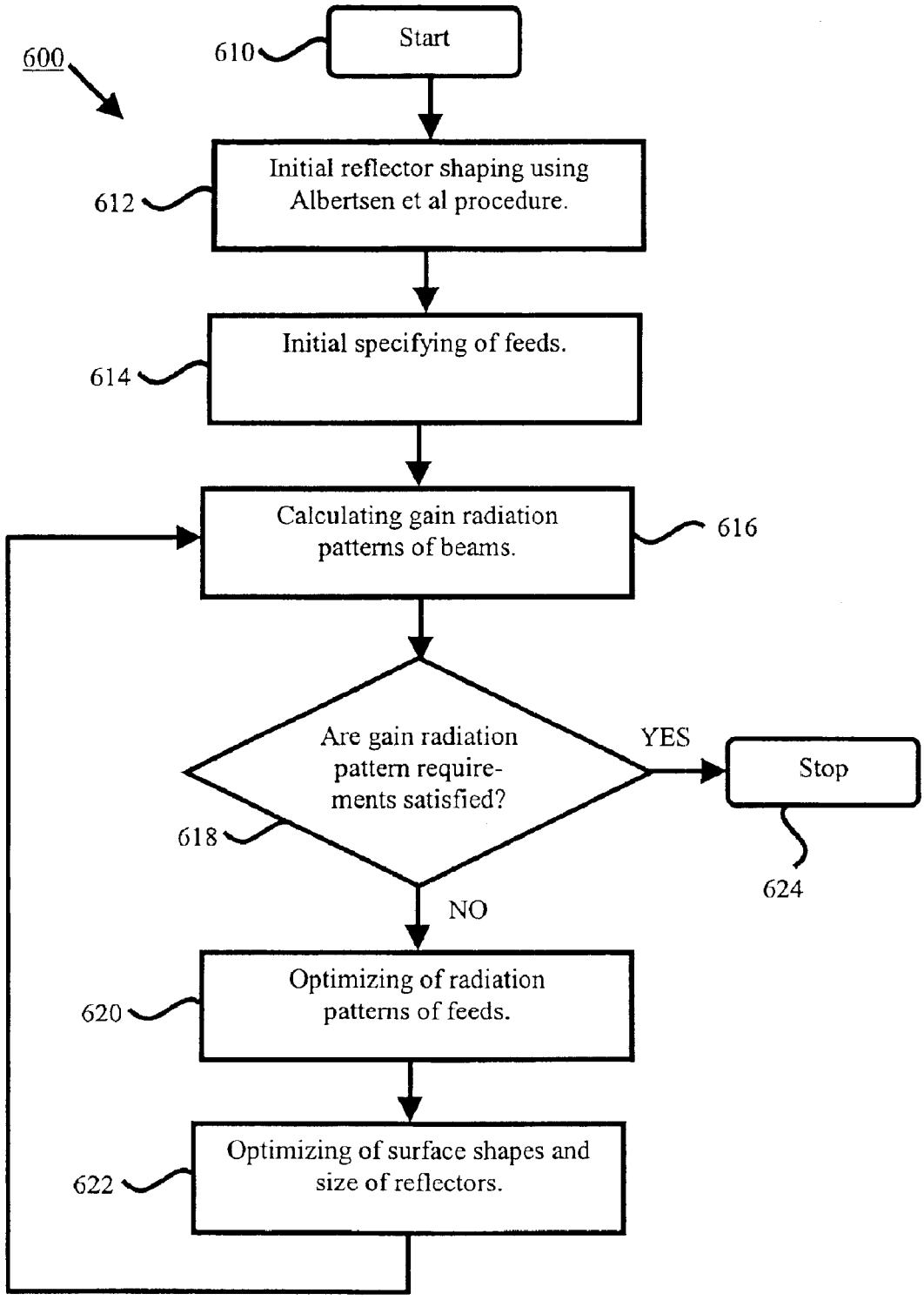
FIG. 6 is a flow diagram illustrating a design process for a multibeam antenna in accordance with an embodiment of the invention.

An initial reflector-shaping process and an initial specification of feeds obtain an initial configuration for the multibeam antenna. FIG. 6 is a flow diagram illustrating a design process 600 for a multibeam antenna. Processing commences at step 610. The surface shapes of the reflectors 110, 120 are initially specified by an iterative optimization procedure in step 612 that aims to maximize the focusing of optical rays incident on the antenna from the required beam directions. Albertsen, N. Chr., Pontoppidan, K. and Sørsensen, S. B., "Shaping of dual reflector antennas for improvement of scan performance", IEEE Antennas and Propagation Society International Symposium, 1985, pp. 357–360, which is incorporated by cross-reference, propose a reflector-shaping procedure. The foregoing reflector-shaping procedure or process is used in step 612 to obtain a starting point for the process of FIG. 6.

The multibeam dual-reflector reflector-shaping technique proposed by Albertsen et al, referred to above in relation to step 612, first uses a gradient search to find reflector surface shapes that minimize the rms error with which the two reflectors bring to a point focus each group of parallel optical rays incident on the main reflector from a direction within the desired set of beam directions. Feeds are then placed at the focal points and a radiation-pattern analysis using physical optics is applied to predict the radiation patterns of the beams. This simple approach has produced impressive results in a number of situations; see Hay, S. G., "Subreflector shaping to improve the multiple-beam performance of Cassegrain antennas", Electronics Letters, 1987, vol. 23, no. 15, pp. 789–791; Hay, S. G., "Offset dual-reflector multiple-beam antennas using circularly symmetric main reflectors", Electronics Letters, 1987, vol. 23, no. 17, pp. 888–890; and Bird, T. S. and Sprey, M. A., "Scan limitations of shaped dual-reflector antennas for multiple satellite access", Electronics Letters, 1990, vol. 26, no. 4, pp. 228–230. The maximum gains of the resulting beams are significantly greater than those obtained using unoptimized reflector surfaces.

In step 614, the feeds for the multibeam are initially specified. The feeds for the multibeam antenna may be initially specified as rotationally symmetric corrugated horns with either linear or sine-squared profiles. Clarricoats, P. J. B. and Olver, A. D., "Corrugated horns for microwave antennas", Peter Peregrinus Ltd, London, 1984, have described such horns, which are used in step 614.

In step 616, the radiation patterns of the beams of the initial configuration of the multibeam antenna are calculated using the methods of physical optics and the physical theory of diffraction. In decision step 618, the calculated radiation patterns are then compared to requirements for an application to determine the suitability of the design.

In the physical-optics radiation-pattern analysis referred to above, a complete analysis comprising the spillover lobes requires the summation of three fields: that due to the feed alone, the subreflector current, and the main-reflector current. This capability has been available for some time in commercially available software, described in Pontoppidan, K., "Technical description of GRASP7 and GRASPC", TICRA Engineering Consultants, S-359-03, 1993. The physical-optics software has been extended with the addition of the physical theory of diffraction, which improves the accuracy of edge-diffraction prediction, see Bird, T. S. and James, G. L., "Design and Practice of Reflector Antennas and Feed Systems in the 1990s", Review of Radio Science 1996–1999, U.R.S.I., Oxford Science Publications, pp. 81–117. Additional software that automates the process of running the analysis programs and adding the field components has been developed, see G. C. James, T. S. Bird, S. G. Hay, F. R. Cooray & C. Granet, "A hybrid method of analysing reflector and feed antennas for satellite applications", Proc. 2000 Int. Symposium on Antennas & Propagat., Fukuoka, Japan, 21–25 Aug. 2000, pp. 49–52.

The requirements for the radiation patterns of the beams of the multibeam antenna may take various forms. For earth-station applications in satellite communications, the usual form of requirements include upper and lower bounds for the co- and cross-polarized components of the gain radiation patterns of the beams over a range of frequencies. For sufficient signal strength, the bounds include a lower bound on the co-polar gain of each beam in its desired direction and, to allow independent use of orthogonal polarizations, an upper bound is normally placed on cross-polar gain within a subset of the main lobe of each beam. For isolation from other systems, an upper bound on beam sidelobes is specified, for example:

$$G \leq \begin{cases} 29 - 25\log_{10}\theta & 1^\circ \leq \theta \leq 36^\circ \\ -10 & 36^\circ \leq \theta \leq 180^\circ, \end{cases} \quad (1)$$

where G is the total gain (ie sum of co- and cross-polar) expressed in dBi, and θ is the angle in degrees from the beam axis. An upper bound also applies to the antenna noise temperature, which takes the form of an integral of the product of the antenna gain pattern and the directional distribution of environmental temperature. Site-specific data on the latter distributions may not be available but approximate models can be applied, giving useful estimates for design purposes, as described in James, G. L., "Analysis of radiation pattern and G/T for shaped dual-reflector antennas", IEE Proceedings, Part H, 1980, vol. 127, no. 1, pp. 52–53.

Figure 2A:
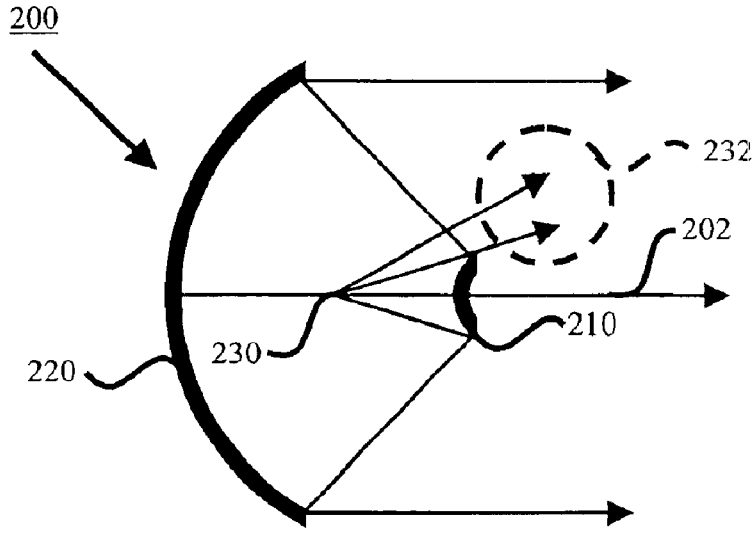
FIGS. 2A and 2B are block diagrams illustrating spillover in single-beam and multibeam dual-reflector antennas, respectively.
Figure 2B:
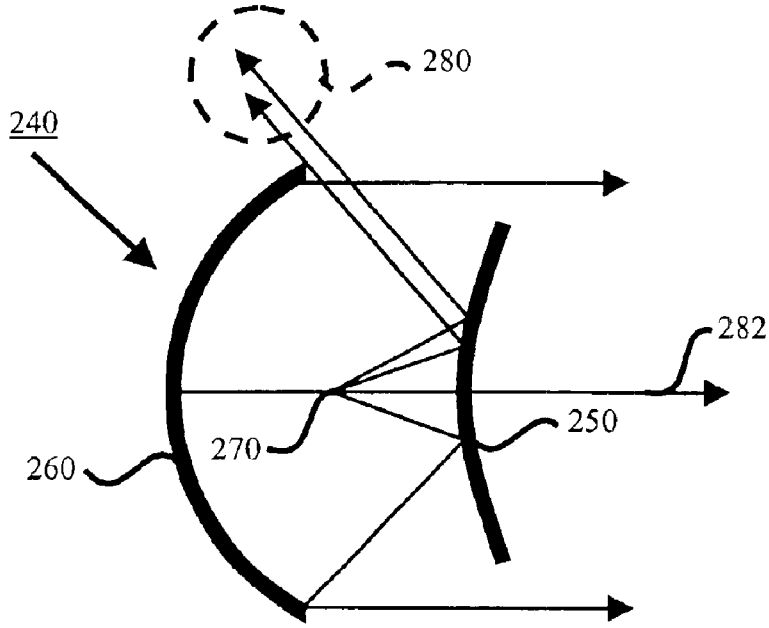

A significant difference between the radiation patterns of the single-beam and multibeam dual-reflector antennas 200, 240 in FIGS. 2A and 2B, respectively, can exist if all sidelobes are required to be within an envelope of the above form. In FIGS. 2A and 2B, the arrows 202 and 282 respectively indicate the beam direction of the antennas 200, 240. As illustrated in FIG. 2B, in the multibeam case 240, some of the sidelobes of the feed radiation 270 are reflected by the large subreflector 250 and may spill over 280 past the edge of the main reflector 260 into the radiation-pattern region where the sidelobe envelope is most stringent. In contrast, in the single-beam case 200 of FIG. 2A, this radiation from the feed 230 may be allowed to spill over 232 past the subreflector 210 edge into the region where the sidelobe envelope is less demanding. For a given feed radiation pattern and subreflector, these rear spillover lobes of the multibeam antenna 240 can be decreased only by increasing the size of the main reflector 260 over that which is sufficient to satisfy all other requirements. Such an increase may impact on the cost of the antenna 240.

Figure 3B:
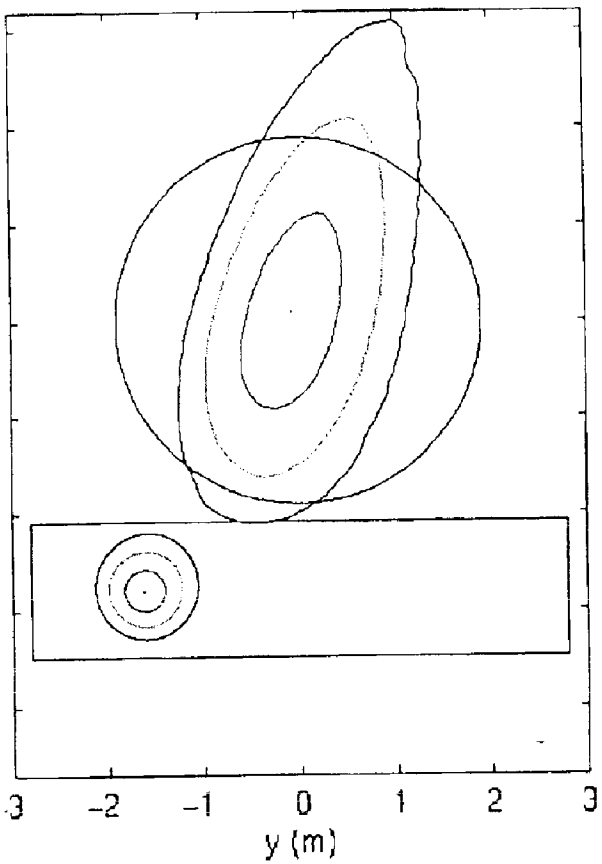
FIG. 3B is a graph of transmit-mode reflector illuminations at 10.7 GHz for +18° beam of original design for a multibeam antenna, in which contours are at power densities of −3, −10 and −20 dB relative to the maximum illumination.
Figure 3A:
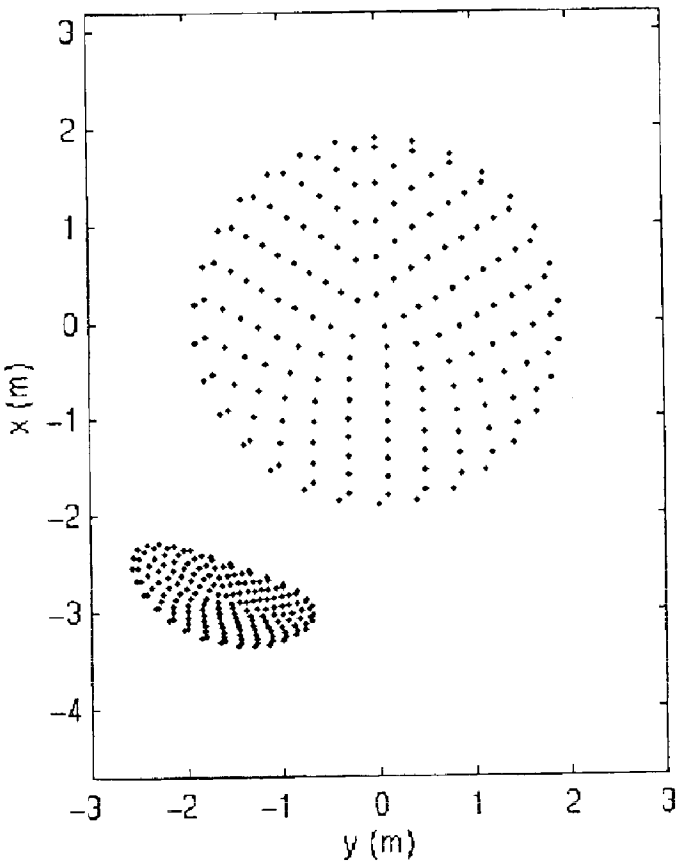
FIG. 3A is a graph of receive-mode rays on reflectors at 10.7 GHz for +18° beam of original design for a multibeam antenna.
Figure 4A:
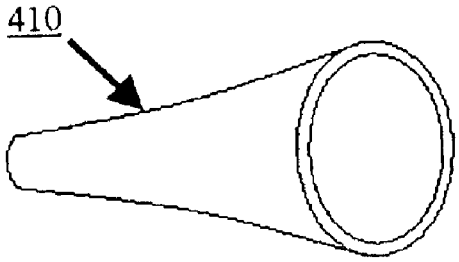
FIGS. 4(*a*)–4(*f*) are diagrams illustrating feeds for multibeam reflector antennas, comprising (a) a rotationally symmetric horn, (b) an elliptical-aperture horn, (c) a lens-corrected horn, (d) a shaped reflector with waveguide feed, (e) a single-reflector periscope, and (f) a dual-reflector periscope, respectively.
Figure 4B:
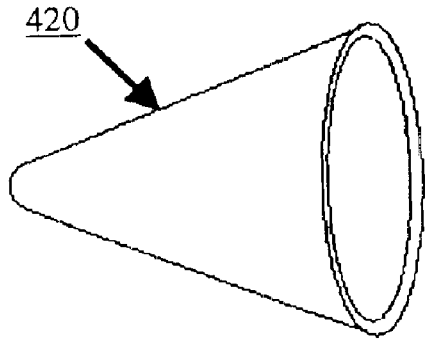
Figure 4C:
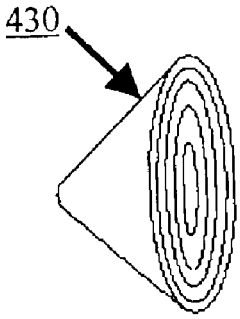
Figure 4D:
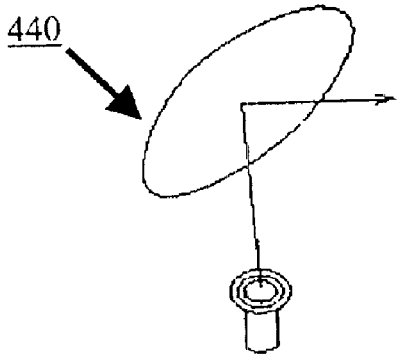
Figure 4E:
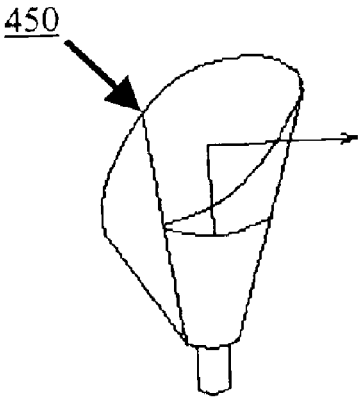
Figure 4F:
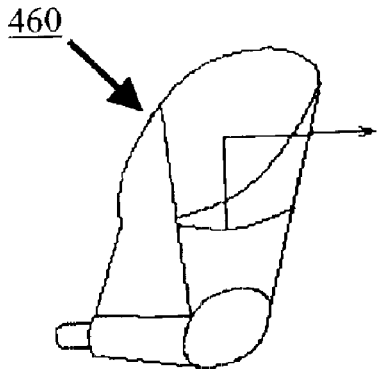

FIGS. 3A and 3B illustrate the application of the design approach described hereinbefore to a beam-direction range of +/−20°. This results in an unusual subreflector surface in the sense that the surface is partly anticlastic. In FIG. 3A, the intersection points of the receive-mode optical rays and the main and sub-reflectors for the 18° off-axis beam are shown. The technique is effective at bringing to point foci all of the parallel-ray groups incident on the main reflector from within the specified +/−20° beam-direction range, but there is considerable loss of rotational symmetry of the ray groups as the ray groups converge to the foci. Consequently, as illustrated in FIG. 3B, when the usual rotationally symmetric horn feeds are used to illuminate the reflectors, the results of physical-optics analysis show that the antenna has highly elliptical illuminations of the main reflector and either low illumination efficiency or high spillover lobes in the region behind the main reflector. The latter effect adds to the spillover lobes described hereinbefore.

Moreover, in the far field, the main beams have elliptical cross-sections where the major axes lie in the beam-direction plane, and this reduces the minimum spacing of neighbouring beams of a given maximum gain.

Improvement of the main-reflector illuminations in this antenna may be obtained by various means. One approach would be to simply reduce the specified beam-direction range for the antenna and use a number of such antennas to achieve the required total beam coverage. The question of optimally dividing the required beam coverage among a number of multibeam antennas has been given consideration but requires further analysis with reference to the effects of loss of beam rotational symmetry. Another approach is optimization of the radiation patterns of the feeds or the surface sizes and shapes of the reflectors.

4. Optimization of Feed Radiation Patterns

Another approach for improving the main-reflector illuminations is to replace the rotationally symmetric feeds with feeds whose radiation patterns are shaped so as to compensate for the distorting effects of the subreflector. FIGS. 4(*a*)–4(*f*) illustrate a range of possible feed structures 410–460, respectively. Shaped-aperture horns 410 are one possibility and the use of elliptical-aperture horns 420 for this purpose has been suggested previously, see Sletten C. J. and Carrillo, S. E., "Scanning multibeam communication antennas", IEEE Antennas and Propagation Society International Symposium, 1984, pp. 474–477. FIG. 4(*c*) shows a lens-corrected horn 430. Such horns could be machined from aluminum castings and some insight into the best aperture shapes could be obtained through analysis of the focal-region fields of the antenna. Rectangular-aperture horns could be machined from standard aluminum plates as is commonly done for corrugated-waveguide polarizers in feed systems. Another possible feed is a small offset-fed reflector 440 where the surface of the reflector is shaped so as to produce a shaped radiation pattern that improves the illuminations of the main reflector. This option may give the additional advantage of lower cost. An extension of this concept is the periscope feed or horn-reflector antenna 450, 460, which may have further advantages in minimizing sidelobes of the feed radiation pattern or in its mechanical design.

Figure 7:
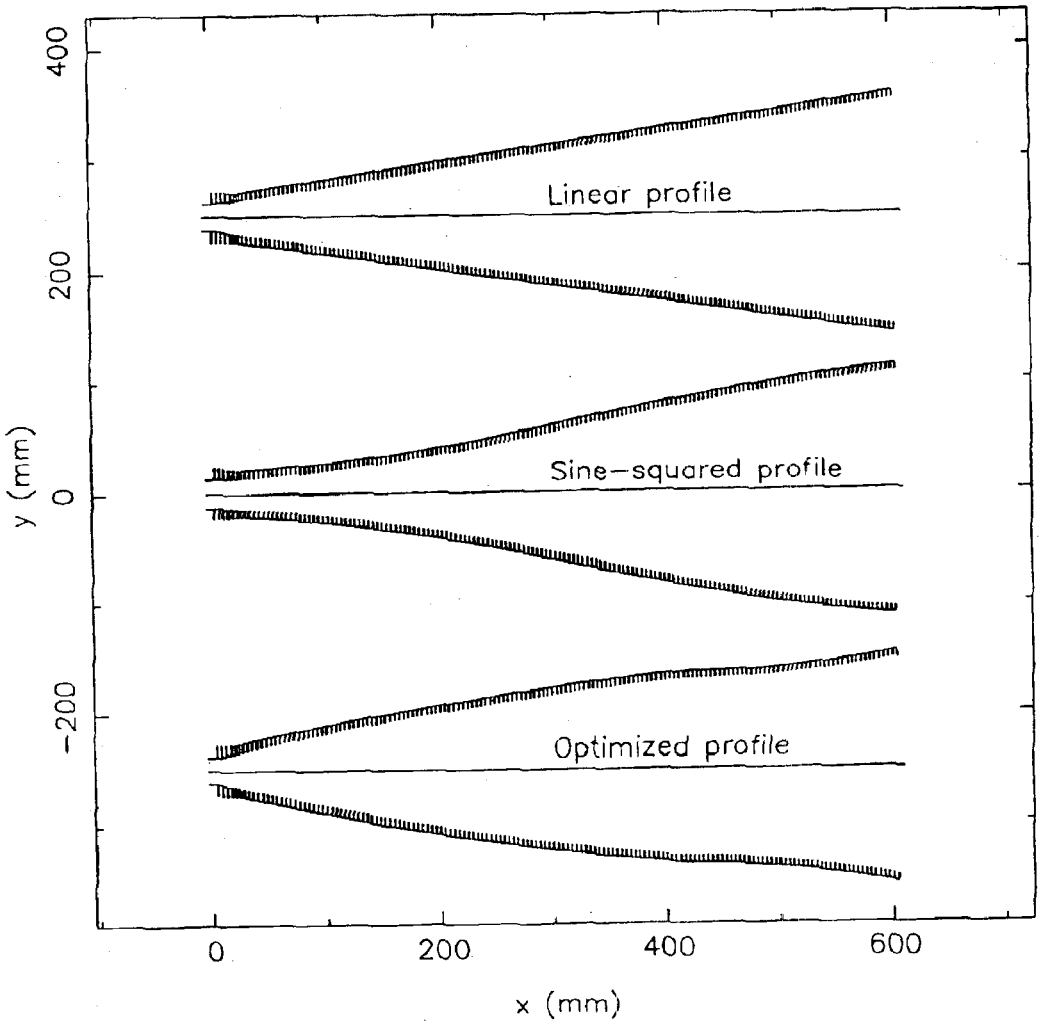
FIG. 7 is a graph of profiles of horn feeds for a multibeam antenna.
Figure 8:
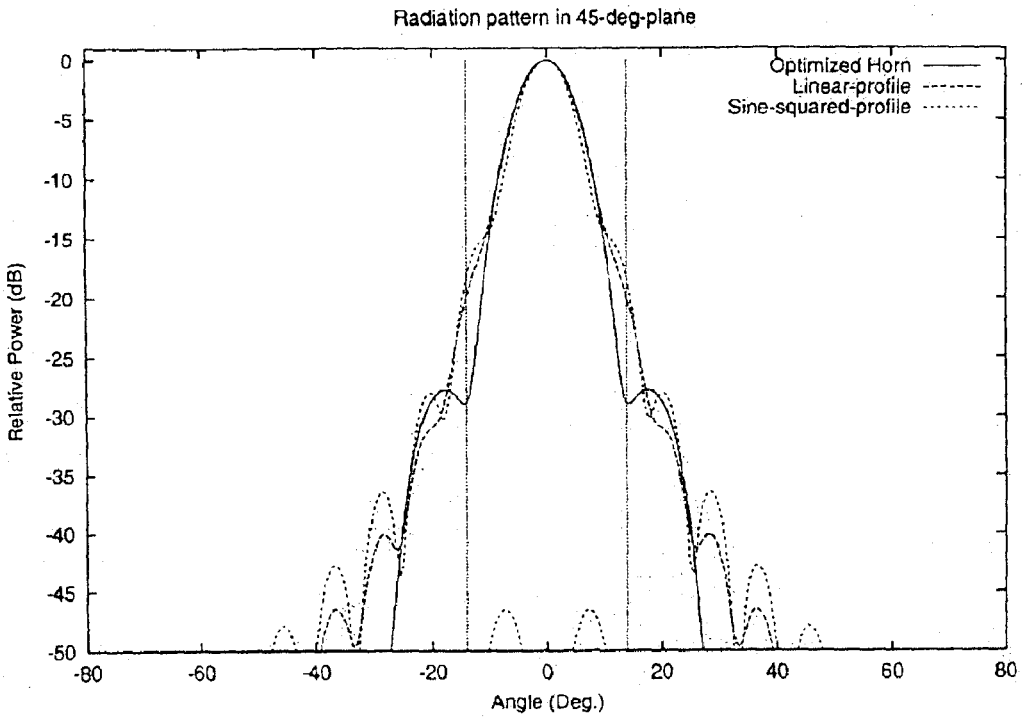
FIG. 8 is a graph of radiation patterns of horn feeds for a multibeam antenna.

In the embodiment of the invention, optimum shaping of the profile of the rotationally symmetric corrugated horn feed has been used to reduce the spillover sidelobes over the required operating frequency range. The profile is parameterized in terms of a small number of parameters and a gradient search is applied to minimize the maximum gain of the horn radiation pattern for off-axis angles greater than a specified value. The process is described in Granet, C., and Bird, T. S., "Optimization of corrugated horn radiation patterns via a spline-profile", ANTEM 2002, 9th International Symposium on Antenna Technology and Applied Electromagnetics, Montreal, Canada, 2002, pp 307–310. FIG. 7 illustrates the optimum profile and corresponding radiation patterns found in a particular case, where the minimum sidelobe-region off-axis angle is taken to be 11°. FIG. 8 compares the maximum sidelobe level to that obtained using the same horn length and aperture diameter but previously proposed profiles including the linear and sine-squared types. The optimized profile produces lower radiation-pattern sidelobes and lower spillover lobes in the region behind the main reflector of the multibeam antenna.

5. Reflector Optimization

Yet another approach to improving the performance of the antenna is through the use of more effective reflector-optimization techniques. The Albertsen et al (referred to above) reflector-shaping technique minimizes aberrations without regard to illuminations and the small aberrations that result suggest that some improvement will be obtained through the application of a procedure that refers directly to the requirements for the radiation patterns and allows a best compromise between aberrations and illuminations to be found.

In principle, a more effective reflector-shaping procedure uses physical-optics transmit-mode radiation-pattern analysis based on numerical current integration, within a gradient search for optimum reflector shapes. This capability has been developed previously within CSIRO, see Hay S. G., "Program DRASYS", Esoft, CSIRO Division of Radiophysics, 1992, and was applied for example to design a dual-reflector feed for a radiotelescope, see Granet, C., James, G. L. and Pezzani, J., "A new dual-reflector feed system for the Nancay radiotelescope", IEEE Transactions on Antennas and Propagation, 1997, vol. 45, pp. 1366–1373. However, the computational burden of the approach is large and can prohibit its application to the multibeam antenna where the reflectors are large compared to the wavelength and the radiation patterns of a number of beams must be evaluated at each step of the iterative process.

The physical-optics transmit-mode radiation-pattern analysis can be replaced by an equivalent analysis based on correlation of receive- and transmit-mode fields at the surface of the subreflector, Wood, P. J., "Reflector antenna analysis and design", Peter Peregrinus Ltd, London, 1980, pp. 86–93. The geometrical theory of diffraction can be used to calculate rapidly the receive-mode fields at a number of frequencies and this has been proposed and used previously as a basis for optimizing the shapes of single-beam reflector surfaces, see Clarricoats P. J. B and Poulton, G. T., "High efficiency microwave reflector antennas—A review", Proceedings of the IEEE, 1977, vol. 65, pp. 1470–1504. The approach has also been used for finding beam-forming excitations for array feeds, see Bird, T. S., "Contoured-beam synthesis for array-fed reflector antennas by field correlation", IEE Proceedings, Part H, 1982, vol. 129, no. 6, pp. 293–298. One receive-mode field is used for each point in the radiation pattern, and so the pattern in a limited number of critical directions, in particular around the main-lobe and the front and rear spillover sidelobes, can be evaluated much more rapidly than in the transmit-mode physical optics analysis. This approach has been used as the basis of a gradient search for reflector shapes that satisfy the radiation-pattern envelope requirements for the various beams in the multibeam antenna. The rapid analysis also allows the reflector sizes and rim shapes to be varied as necessary to obtain a satisfactory design. The procedure is simplified by certain techniques and assumptions, subsequently verified by the analysis by physical optics and the physical theory of diffraction. A mathematical description is given in section 8 hereinafter.

Figure 5:
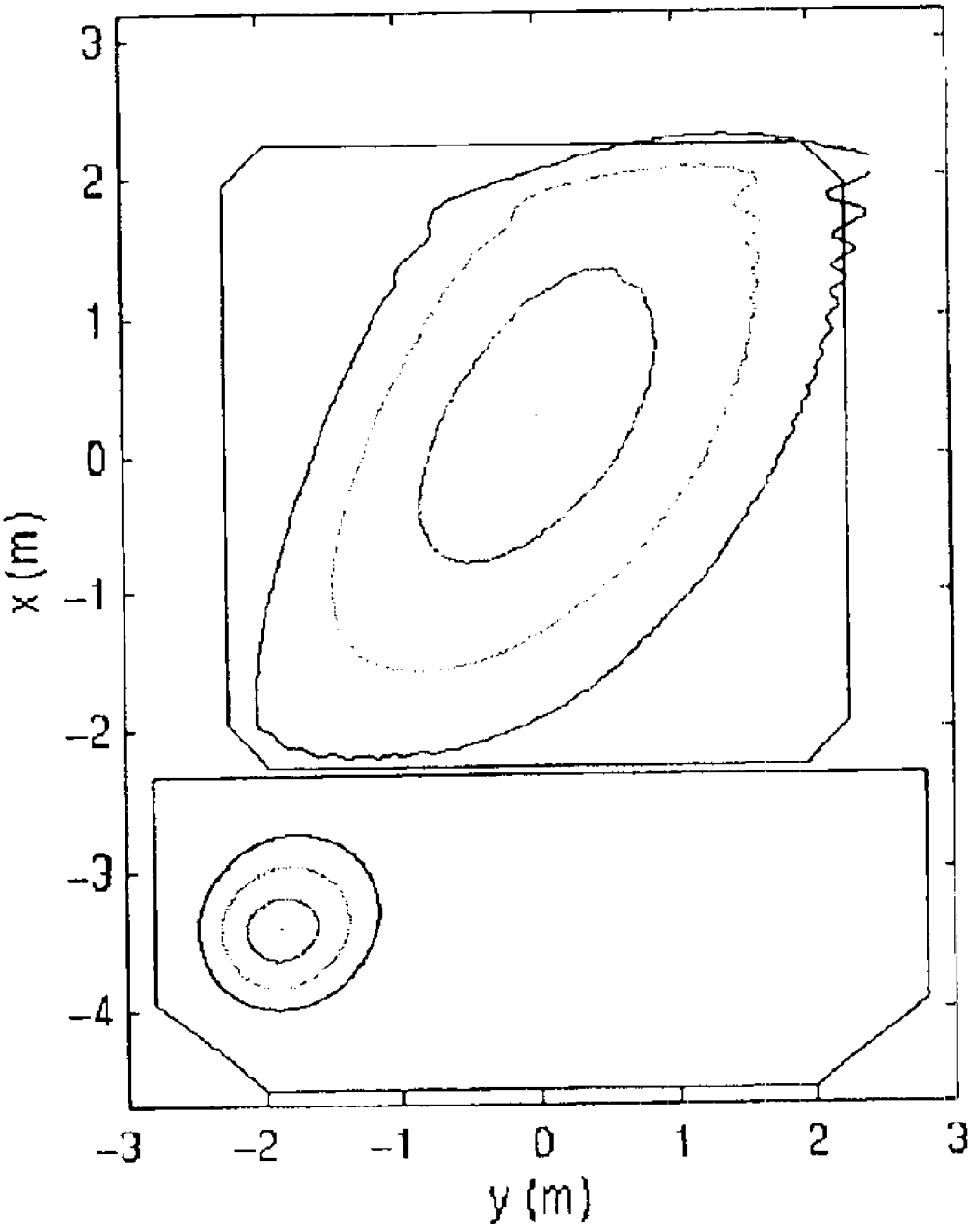
FIG. 5 is a graph of reflector illuminations for +18° beam at 10.7 GHz in a final design for a multibeam antenna, in which contours are at power densities of −3, −10 and −20 dB relative to the maximum illumination.

FIG. 5 illustrates the improved design obtained by applying the new procedures. FIG. 5 shows that the beams of the improved design have a greater degree of rotational symmetry compared to the beams of the original design, illustrated in FIG. 3B. Some increase in the size of the reflectors also was made to reduce the spillover sidelobes of the improved design to an acceptable level.

6. Flow Diagram

FIG. 6 shows a flow diagram of the design process 600 in accordance with an embodiment of the invention. This process aims to control the focusing and symmetry of each beam in the multibeam antenna. Processing starts at step 610. In step 612, Cassegrain reflectors are specified and the initial reflector-shaping process of Albertsen el at (referred to hereinbefore) is applied to these reflectors. Step 612 comprises the process of determining the application requirements for beam directions and gain radiation patterns of the beams of the multibeam antenna. In step 614, initial feeds for the multibeam antenna design are specified. That is, specific feeds having a nominal design are chosen. In step 616, the gain radiation patterns of the beams of the initial design for the multibeam antenna are calculated.

In decision block 618, a check is made to determine if the initial design satisfies all the requirements for the multibeam antenna. If decision block 618 returns true (yes), processing terminates in step 624. Otherwise, if decision block 618 returns false (no), processing continues at step 620. In step 620, optimizing of feed radiation patterns is applied for control of the reflector illuminations in the multibeam antenna. In this embodiment of the invention, the profiles of horn feeds are optimized to reduce sidelobes and thus adjust the illumination of the reflectors in the multibeam antenna. FIG. 7 illustrates three horn-feed profiles comprising an optimized horn profile in accordance with this embodiment of the invention. In step 622, reflector surface shape and size optimizing is applied. Details of this process in this embodiment of the invention are set forth in Table 1. While a specific sequence has been shown for steps 620 and 622, the ordering of these steps may be changed without departing from the scope and spirit of the invention. Processing then continues at step 616. Steps 616, 618, 620 and 622 may be repeatedly applied in an iterative optimization process at arrive at a satisfactory design for the multibeam antenna satisfying the application requirements.

For example, the process of FIG. 6 may be used to design a multibeam antenna with 20 beams and feeds. Other numbers of beams and feeds may be practiced without departing from the scope and spirit of the invention.

7. Specific Antenna Designed

In accordance with the embodiments of the invention, a multibeam dual-reflector antenna has been designed for earth-station access to communications satellites in geostationary orbit. The antenna operates at Ku band where it produces up to 20 beams, with a minimum spacing of 2°, anywhere within a 38° field of view. All beams have maximum gain exceeding 50 dBi, cross-polarization less than −30 dB and sidelobes within a stringent envelope that should allow the antenna to be operated in transmit as well as receive mode.

The design method used in previous work was found in this case to produce a design with unacceptably high spill-over sidelobes. In accordance with the embodiment of the invention shown in FIG. 6, these lobes were decreased to an acceptable level by increasing the size of the reflectors, shaping the reflector surfaces so as to improve the beam rotational symmetry and shaping the profile of the horn feeds for low sidelobes in the feed radiation pattern. For the reflector shaping, a technique based on receive-mode analysis using the Geometrical Theory of Diffraction (GTD) gave some improvement in the design whereas techniques based on transmit-mode analysis using physical optics or GTD were of limited use because of the computational burden and the existence of Geometrical Optics (GO) caustics respectively.

8. Reflector-Shaping Procedure

A flow diagram of the process used to design a multibeam antenna is given in FIG. 6. The extension of the reflector-shaping procedure is described hereinafter.

The gain pattern of an antenna may be defined in terms of the field that the antenna produces in free space, as seen from a coordinate system where the antenna is at rest. In such a system, let r,θ,ϕ be spherical coordinates of a point P. If r is large then the field at P takes the form $$E_1 = \frac{e^{-jkr}}{r} K_1 \qquad K_1 \cdot \hat{r} = 0$$

$$H_1 = \frac{1}{\eta} \hat{r} \times E_1$$

where $E_1$ and $H_1$ are the electric and magnetic components respectively of the field, the vector $K_1$ is independent of r but depends on θ and ϕ, and η and k are the impedance and wavenumber respectively of free space. The power density of the field is given by $$S_1 = \frac{1}{2} \Re\{E_1 \times H_1^*\}$$

$$= \hat{r} \frac{1}{r^2} \frac{1}{2\eta} |K_1|^2$$

and the gain pattern of the antenna is defined as $$G_1 = \lim_{r \to \infty} \frac{|S_1|}{P_1 / (4\pi r^2)}$$

$$= |F_1|^2 \qquad F_1 = \sqrt{\frac{4\pi}{2\eta P_1}} K_1$$

where $P_1$ is the power of the source of the field. Co- and cross-polarized gain patterns may be defined as $$G_1^{co} = |F_1 \cdot \hat{F}^{co}|^2 \quad G_1^{cross} = |F_1 \cdot \hat{F}^{cross}|^2$$

where $\hat{F}^{co}$ and $\hat{F}^{cross}$ are unit vectors, each orthogonal to the other and to $\hat{r}$, representing orthogonal polarizations of the field. The gain pattern $G_1$ equals the sum of $G_1^{co}$ and $G_1^{cross}$.

For the multibeam antenna, gain patterns are defined for each beam, or the field produced by an input to each feed whilst the ports of all other feeds are terminated in matched loads. The requirements for the antenna comprise lower bounds for the co-polarized gains in the required beam directions, upper bounds for the cross-polarized gains within the regions where the corresponding co-polar gains are within 1 dB of their peaks, and upper bounds for the total gains (ie sum of co- and cross-polar) in the sidelobe regions greater than 1° from the co-polar peaks. A satisfactory design is obtained iteratively, using a gradient search to vary the shapes of the reflector surfaces so as to reduce a sum of weighted gain-pattern errors, and increasing the size of the reflectors in a trial-and-error fashion. Within the gradient search the gain patterns are calculated in only a limited number of directions, near the main lobe and the front and rear spillover lobes of each beam.

To calculate the gain patterns, the field component $K_1 \cdot \hat{F}_2$ ($\hat{F}_2 = \hat{F}^{co}$ or $\hat{F}^{cross}$) is expressed in terms the coupling $$K_1 \cdot \hat{F}_2 = \frac{-jk\eta}{4\pi} \oint_S \int (E_1 \times H_2 - E_2 \times H_1) \cdot dS$$

of the field $E_1$, $H_1$ and the field $E_2$, $H_2$ produced in and around the antenna by the incident plane wave $$E_{2,i} = \hat{F}_2 e^{jkr\hat{r}}$$

$$H_{2,i} = -\frac{1}{\eta} \hat{r} \times E_{2,i}.$$

In the coupling integral, the surface S can be any closed surface that encloses the source of the field $E_1$, $H_1$ and dS is normal to S and points toward the outside of S. The field $E_2$, $H_2$ may alternatively be taken as the field produced when the plane wave is incident on the antenna when any of its components within S vanish. The reason is that the difference between the two versions of $E_2$, $H_2$ is a field that can be represented in terms of an equivalent source within S, and the coupling of any two fields whose sources are on the same side of S is zero. Similarly, the field $E_1$, $H_1$ may be replaced by the field radiated by the antenna sans any of its components outside S.

The surface S is taken to enclose the feed and subreflector but not the main reflector. The receive-mode field $E_2$, $H_2$ is taken to be that produced by the incident plane wave and the main reflector alone, and the transmit-mode field $E_1$, $H_1$ is taken to be that produced by the incident field of the feed and the subreflector alone. These fields are calculated from their known incident components using the geometrical theory of diffraction, see James, G. L., "Geometrical theory of diffraction for electromagnetic waves", Peter Peregrinus Ltd, London, 1986. Thus $$(E_2, H_2) = U_{2,i}(E_{2,i}, H_{2,i}) + (E_{2,r}, H_{2,r}) + (E_{2,d}, H_{2,d}) \text{and}$$

$$(E_1, H_1) = U_{1,i}(E_{1,i}, H_{1,i}) + (E_{1,r}, H_{1,r}) + (E_{1,d}, H_{1,d})$$

where the subscripts i, r and d denote the incident, reflected and edge-diffracted components respectively of the field; the coefficient $U_{2,i}$ is 0 if the ray from the field point to infinity in the direction $\hat{r}$ intersects the main reflector and is 1 otherwise; the coefficient $U_{1,i}$ is 0 if the ray from the field point to the phase center of the feed intersects the subreflector and is 1 otherwise.

When the incident plane wave $E_{2,i}$,$H_{2,i}$ is coming from the forward hemisphere, the incident plane wave is present at all points on S and its coupling to the transmit-mode field reproduces the radiation pattern of the subreflector and feed. This component is calculated separately. When the incident plane wave is coming from the rear hemisphere, the incident plane wave is retained where necessary in the coupling integral, and the reflected field component is zero on S. Thus $$K_1 \cdot \hat{F}_2 = r e^{jkr}(U_{1,i}E_{1,i} + E_{1,d}) + \frac{2jk\eta}{4\pi}\int_{S_2}((E_{2,r} + E_{2,d}) \times H_{1,i}) \cdot dS_2 \quad z \geq 0$$

$$= \frac{2jk\eta}{4\pi}\int_{S_2}((U_{2,i}E_{2,i} + E_{2,d}) \times H_{1,i}) \cdot dS_2 \quad z < 0$$

where $S_2$ is the surface of the subreflector and the physical-optics approximation $H_{1,d}=0$ at $S_2$ has been used.

To eliminate a requirement for two-dimensional numerical searching for reflection points on the main reflector, the coupling integral involving the reflected field is evaluated in terms of points on this reflector. Thus $$\int_{S_2}(E_{2,r} \times H_{1,i}) \cdot dS_2 = \int_{S_1}(E_{2,r}^2 \times H_{1,i}) \cdot \frac{dS_2}{|dS_2|}\frac{|E_{2,r}^1|^2\cos\theta_1}{|E_{2,r}^2|^2\cos\theta_2}U_{2,r}|dS_1|$$

where $S_1$ is the surface of the main reflector, the superscripts 1 and 2 denote quantities evaluated at the main reflector and subreflector respectively, θ is angle between the main-reflector reflected ray and the normal to the reflector surface, and $U_{2,r}$ is 1 if the reflected ray intersects the subreflector and is 0 otherwise. When $U_{2,r}$ is 1, the point where the reflected ray intersects the subreflector is found by a one-dimensional search using Newton's method. Such a search is also used to determine the edge-diffraction points for the edge-diffraction fields.

Both reflector surfaces are specified by equations of the form $z=f(x,y)$ $(x,y)\epsilon A$ where x, y, z are rectangular coordinates of points in space, A is a convex polygon and the function $f$ is the sum of a function representing a quadric surface and a bicubic spline. It is the parameters of the splines that are varied to optimize the reflector shapes.

To evaluate the reflected and edge-diffracted fields, the principal curvatures of their respective wavefronts must be known. These curvatures have been expressed in terms of certain normal curvatures of the reflector surface and the vector curvature of the reflector edge, see James, G. L., "Geometrical theory of diffraction for electromagnetic waves", Peter Peregrinus Ltd, London, 1986. Expressions for the reflector curvatures can be derived from general formulae, or final results for the wavefront curvatures can be obtained directly by differentiating the ray congruences, see Weatherbum, C. E., "Differential geometry of three dimensions", Cambridge University Press, 1961. The principal radii $\rho_1$, $\rho_2$ of curvature of the reflected field at the surface of the main reflector can be derived as $$\rho_1\rho_2 = \frac{(1 + f_x^2 + f_y^2)^2}{4(f_{xx}f_{yy} - f_{xy}^2)}$$

$$\rho_1 + \rho_2 = \frac{(1 + f_x^2 + f_y^2)^{1/2}}{2\hat{r}\cdot\hat{n}} \frac{f_{yy}[1 + f_x^2 - (\hat{r}\cdot e_x)^2] + f_{xx}[1 + f_y^2 - (\hat{r}\cdot e_y)^2] - 2f_{xy}[f_xf_y - (\hat{r}\cdot e_x)(\hat{r}\cdot e_y)]}{(f_{xx}f_{yy} - f_{xy}^2)}$$

where $$e_x=\hat{x}+f_x\hat{z}$$

$$e_y=\hat{y}+f_y\hat{z} \text{ and}$$

$$\hat{n}=(-\hat{x}f_x-\hat{y}f_y+\hat{z})/(1+f_x^2+f_y^2)^{1/2}$$

is a unit vector normal to the reflector surface. In these equations $f$ is the function representing the main-reflector surface and the subscripts on $f$ denote partial derivatives in the usual way. The vector curvature κ of the reflector edge can be derived as $$\kappa = \frac{\delta_x^2 f_{xx} + \delta_y^2 f_{yy} + 2\delta_x\delta_y f_{xy}}{\delta_x^2 + \delta_y^2 + (\delta_x f_x + \delta_y f_y)^2}(\hat{z} - \hat{z}\cdot\hat{t}\hat{t})$$

where $$\hat{t}=[\delta_x\hat{x}+\delta_y\hat{y}+(\delta_x f_x+\delta_y f_y)\hat{z}]/[\delta_x^2+\delta_y^2+(\delta_x f_x+\delta_y f_y)^2]^{1/2}$$

is a unit vector tangent to the edge and $\delta_x=x_2-x_1$ and $\delta_y=y_2-y_1$ where $(x_1, y_1, z_1)$ and $(x_2, y_2, z_2)$ are the two end points of the edge in question.

The problem of evaluating the various shadow coefficients $U_{1,i}$, $U_{2,i}$, $U_{2,r}$ is that of determining whether a given ray $(x_0, y_0, z_0)+t(s_x, s_y, s_z)$ $t>0$ intersects a surface of the form $z=f(x,y)$ $(x,y)\epsilon A$ where $f$ is a given function on a given convex region A. It is assumed that there is at most one intersection point. With this assumption, the ray intersects the surface if and only if one of the following conditions is true.

(a) the ray is parallel to the z axis, $(x_0,y_0)\epsilon A$ and $f(x_0, y_0)-z_0$ is of the same sign as $s_z$ (b) the ray intersects the surface of the cylinder $(x,y)\epsilon A$ at only one point, $(x_1, y_1, z_1)$ say, and $f(x_1,y_1)-z_1$ is of opposite sign to $f(x_0,y_0)-z_0$ (c) the ray intersects the cylinder at two points, $(x_1, y_1, z_1)$ and $(x_2, y_2, z_2)$ say, and $f(x_1,y_1)-z_1$ is of opposite sign to $f(x_2,y_2)-z_2$.

The region A is a polygon and any intersection points of the ray and the surface of the cylinder are easily determined using elementary analytic geometry.

The feed positions in the multibeam antenna can be calculated as in the Albertsen et al (referred to above) procedure, minimizing the rms distance of the feed phase center from the receive-mode rays reflected by the subreflector. However, in the effort to improve the reflector illuminations, a modified feed-point calculation is needed to prevent the feeds from blocking the beams. Thus a constraint was applied that the feed point must be within a specified halfspace. The feed point minimizing the rms distance to the receive-mode rays, subject to this constraint, was used and can be shown to be given by $$p = p_0 - \frac{b_0}{v^t(I-M)^{-1}v}(I-M)^{-1}v$$

$$p_0 = (I-M)^{-1}u$$

$$b_0 = (p_0 - l)^t v$$

$$u = \frac{1}{n}\sum_{i=1}^{n}[q_i - (q_i^t\hat{s}_i)\hat{s}_i]$$

$$M = \frac{1}{n}\sum_{i=1}^{n}\hat{s}_i\hat{s}_i^t$$

where $q_i+t_i\hat{s}_i$ $t_i>0$ $i=1,2, \ldots, n$ is the congruence of receive-mode rays and $(p-l)^t v \geqq 0$ is the blockage-free constraint. This procedure was also found to have its limitations, however, due to rays with large error, from near the edges of the subreflector, having an undue influence of the calculated feed point. In the final stages of the design process, the feed positions were improved by small variations within the gradient search.

9. Computer Implementation

The embodiments of the invention are preferably computer implemented. In particular, the processing or functionality of FIGS. 6 and 9 and the process described in section 8 above be implemented as software, or a computer program, executing a computer. The method or process steps for electromagnetically designing shaped-reflector multibeam antennas may be effected by instructions in software comprising relevant data that are carried out by the computer. The software may be implemented as one or more modules for implementing the process steps. A module is a part of a computer program that usually performs a particular function or related functions. Also, as described hereinbefore, a module can also be a packaged functional hardware unit for use with other components or modules.

In the software sense, a module is a process, program, or portion thereof, that usually performs a particular function or related functions. Such software may be implemented in C, C++, ADA, Fortran, for example, but may be implemented in any of a number of other programming languages/systems, or combinations thereof. In the hardware sense, a module is a functional hardware unit designed for use with other components or modules. For example, a module may be implemented using discrete electronic components, or it can form a portion of an entire electronic circuit such as a Field Programmable Gate Arrays (FPGA), Application Specific Integrated Circuit (ASIC), and the like. A physical implementation may also comprise configuration data for a FPGA, or a layout for an ASIC, for example. Still further, the description of a physical implementation may be in EDIF netlisting language, structural VHDL, structural Verilog or the like. Numerous other possibilities exist. Those skilled in the art will appreciate that the system can also be implemented as a combination of hardware and software modules.

In particular, the software may be stored in a computer readable medium. Relevant storage devices(s) comprise: a floppy disc, a hard disc drive, a magneto-optical disc drive, CD-ROM, magnetic tape or any other of a number of non-volatile storage devices well known to those skilled in the art. The software is preferably loaded into the computer from the computer readable medium and then carried out by the computer. A computer program product comprises a computer readable medium having such software or a computer program recorded on it that can be carried out by a computer. The use of the computer program product in the computer preferably effects advantageous apparatuses for electromagnetically designing shaped-reflector multibeam antennas in accordance with the embodiments of the invention.

The software may be encoded on a CD-ROM or a floppy disk, or alternatively could be read from an electronic network via a modem device connected to the computer, for example. Still further, the software may be loaded into the computer system from other computer readable medium comprising magnetic tape, a ROM or integrated circuit, a magneto-optical disk, a radio or infra-red transmission channel between the computer and another device, a computer readable card such as a PCMCIA card, and the Internet and Intranets comprising email transmissions and information recorded on websites and the like. The foregoing is merely exemplary of relevant computer readable mediums. Other computer readable mediums may be practiced without departing from the scope and spirit of the invention.

The computer system may comprise a computer, a video display, and one or more input devices. For example, an operator can use a keyboard and/or a pointing device such as the mouse (or touchpad, for example) to provide input to the computer. The computer system may have any of a number of other output devices comprising line printers, laser printers, plotters, and other reproduction devices connected to the computer. The computer system can be connected to one or more other computers via a communication interface using an appropriate communication channel such as a modem communications path, a computer network, a wireless LAN, or the like. The computer network may comprise a local area network (LAN), a wide area network (WAN), an Intranet, and/or the Internet, for example.

The computer may comprise one or more central processing unit(s) (simply referred to as a processor hereinafter), memory which may comprise random access memory (RAM) and read-only memory (ROM), input/output (IO) interfaces, a video interface, and one or more storage devices. The storage device(s) may comprise one or more of the following: a floppy disc, a hard disc drive, a magneto-optical disc drive, CD-ROM, DVD, a data card or memory stick, magnetic tape or any other of a number of non-volatile storage devices well known to those skilled in the art. For the purposes of this description, a storage unit may comprise one or more of the memory and the storage devices.

Each of the components of the computer is typically connected to one or more of the other devices via one or more buses that in turn comprise data, address, and control buses. It will be well understood by those skilled in the art that a computer or other electronic computing device such as a PDA or cellular phone may have several buses comprising one or more of a processor bus, a memory bus, a graphics card bus, and a peripheral bus. Suitable bridges may be utilised to interface communications between such buses. While a system using a processor has been described, it will be appreciated by those skilled in the art that other processing units capable of processing data and carrying out operations may be used instead without departing from the scope and spirit of the invention.

The foregoing computer system is simply provided for illustrative purposes and other configurations can be employed without departing from the scope and spirit of the invention. Computers with which the embodiment can be practiced comprise IBM-PC/ATs or compatibles, one of the Macintosh (TM) family of PCs, Sun Sparcstation (TM), a workstation or the like. The foregoing are merely examples of the types of computers with which the embodiments of the invention may be practiced. Typically, the processes of the embodiments are resident as software or a program recorded on a hard disk drive as the computer readable medium, and read and controlled using the processor. Intermediate storage of the program and intermediate data and any data fetched from the network may be accomplished using the semiconductor memory.

In the foregoing manner, a method, an apparatus, and a computer program product for electromagnetically designing shaped-reflector multibeam antennas are disclosed. While only a small number of embodiments are described, it will be apparent to those skilled in the art in view of this disclosure that numerous changes and/or modifications can be made without departing from the scope and spirit of the invention.

The claims defining the invention are as follows:

1. A method of electromagnetically designing a shaped-reflector multibeam antenna, said method comprising the steps of:

providing an initial configuration of reflectors shaped with an initial reflector shaping process and feeds for said multibeam antenna for required beam directions, said reflector shaping process being an iterative optimization process for increasing the focusing of optical rays incident on said multibeam antenna from each of said beam directions;

optimizing radiation patterns of said feeds, said optimizing being an iterative process for satisfying required upper and lower bounds for gain radiation patterns of beams of said multibeam antenna; and optimizing surface shapes and sizes of said reflectors, said optimizing being an iterative process for satisfying said required upper and lower bounds for said gain radiation patterns of said beams of said multibeam antenna.

2. The method according to claim 1, wherein said reflectors are a pair, one reflector being a primary or main reflector illuminated by another reflector being a subreflector, which is illuminated by said feeds.

3. The method according to claim 1, wherein each feed comprises a radiating element or a radiating element combined with one or more reflectors or lenses.

4. The method according to claim 1, wherein said providing step comprises the steps of:

determining requirements for said beam directions and gain radiation patterns;

specifying said reflectors and applying said initial reflector-shaping process;

specifying said feeds having a nominal design;

placing feeds at focal points; and calculating gain radiation patterns of beams of said multibeam antenna, said calculating using the methods of physical optics or the geometrical or physical theories of diffraction.

5. The method according to claim 1, wherein said optimizing step for said radiation patterns of said feeds comprises shaping of said radiation patterns of said feeds to decrease spillover of said beams at one or more of said reflectors of said multibeam antenna.

6. The method according to claim 1, wherein said optimizing step for radiation patterns of feeds comprises shaping said radiation patterns of said feeds to compensate for distorting effects of said reflectors on shapes of said beams or to increase rotational symmetry of said beams at one or more reflectors of said multibeam antenna.

7. The method according to claim 1, wherein said optimizing step for said surface shapes and sizes of said reflectors comprises optimizing said reflectors to increase rotational symmetry or decrease spillover of said beams at one or more of said reflectors of said multibeam antenna.

8. The method according to claim 1, wherein said optimizing steps comprise representing the sizes or shapes of said feeds or said reflectors in terms of a set of variable parameters and optimizing one or more of these parameters.

9. The method according to claim 8, wherein said optimizing steps involve performing a gradient search for said parameters that minimize a weighted sum of gain radiation pattern errors in regard to required upper and lower bounds for said gain radiation patterns of said beams of said multibeam antenna.

10. The method according to claim 8, wherein said optimizing steps involve minimizing the sizes of said reflectors or said feeds whilst satisfying said requirements for said gain radiation patterns of said multibeam antenna.

11. The method according to claim 8, wherein said optimizing step for said radiation patterns of said feeds comprises the steps of:

parameterizing a profile of a horn feed; and applying a gradient search to minimize a maximum gain of a respective feed radiation pattern for off-axis angles exceeding a pre-determined value.

12. The method according to claim 1, wherein said two optimizing steps are performed in one or more iterations to satisfy said requirements for said gain patterns of said multibeam antenna.

13. The method according to claim 1, wherein said optimizing steps comprise calculating said gain radiation patterns of said beams of said multibeam antenna, the said calculating using the methods of physical optics or the geometrical or physical theories of diffraction.

14. An apparatus for electromagnetically designing a shaped-reflector multibeam antenna, said apparatus comprising:

means providing an initial configuration of reflectors shaped with an initial reflector shaping process and feeds for said multibeam antenna for required beam directions, said reflector shaping process being an iterative optimization process for increasing the focusing of optical rays incident on said multibeam antenna from each of said beam directions;

means for optimizing said radiation patterns of said feeds, said optimizing being an iterative process for satisfying required upper and lower bounds for gain radiation patterns of beams of said multibeam antenna; and means for optimizing surface shapes and sizes of said reflectors, said optimizing being an iterative process for satisfying said required upper and lower bounds for said gain radiation patterns of said beams of said multibeam antenna.

15. The apparatus according to claim 14, wherein said reflectors are a pair, one reflector being a primary or main reflector illuminated by another reflector being a subreflector, which is illuminated by said feeds.

16. The apparatus according to claim 14, wherein each feed comprises a radiating element or a radiating element combined with one or more reflectors or lenses.

17. The apparatus according to claim 14, wherein said providing means comprises:

means for determining requirements for said beam directions and gain radiation patterns;

means for specifying said reflectors and applying said initial reflector-shaping process;

means for specifying said feeds having a nominal design;

means for placing feeds at focal points; and means for calculating gain radiation patterns of beams of said multibeam antenna, said calculating means using the methods of physical optics or the geometrical or physical theories of diffraction.

18. The apparatus according to claim 14, wherein said optimizing means for said radiation patterns of said feeds comprises means for shaping of said radiation patterns of said feeds to decrease spillover of said beams at one or more of said reflectors of said multibeam antenna.

19. The apparatus according to claim 14, wherein said optimizing step for radiation patterns of feeds comprises shaping said radiation patterns of said feeds to compensate for distorting effects of said reflectors on shapes of said beams or to increase rotational symmetry of said beams at one or more reflectors of said multibeam antenna.

20. The apparatus according to claim 14, wherein said optimizing means for said surface shapes and sizes of said reflectors comprises means for optimizing said reflectors to increase rotational symmetry or decrease spillover of said beams at one or more of said reflectors of said multibeam antenna.

21. The apparatus according to claim 14, wherein said two optimizing means each comprise means for representing the sizes or shapes of said feeds or said reflectors in terms of a set of variable parameters and optimizing one or more of these parameters.

22. The apparatus according to claim 21, wherein said two optimizing means involve performing a gradient search for said parameters that minimize a weighted sum of gain radiation pattern errors in regard to required upper and lower bounds for gain radiation patterns of beams of said multibeam antenna.

23. The apparatus according to claim 21, wherein said two optimizing means involve minimizing the sizes of said reflectors or said feeds whilst satisfying said requirements for gain radiation patterns of said multibeam antenna.

24. The apparatus according to claim 21, wherein said optimizing means for radiation patterns of feeds comprises:

means for parameterizing a profile of a horn feed; and means for applying a gradient search to minimize a maximum gain of a respective feed radiation pattern for off-axis angles exceeding a pre-determined value.

25. The apparatus according to claim 14, wherein said optimizing means operate in one or more iterations to satisfy said requirements for gain patterns of said multibeam antenna.

26. The apparatus according to claim 14, wherein said two optimizing means each comprise means for calculating the said gain radiation patterns of the beams of said multibeam antenna, said calculating means using the methods of physical optics or the geometrical or physical theories of diffraction.

27. A computer program product having a computer readable medium having a computer program recorded therein for designing a shaped-reflector multibeam antenna, said computer program product comprising computer program code means of providing an initial configuration of reflectors shaped with an initial reflector shaping process and feeds for said multibeam antenna for required beam directions, said reflector shaping process being an iterative optimization process for increasing the focusing of optical rays incident on said multibeam antenna from each of said beam directions;

computer program code means for optimizing radiation pattern of said feeds, said optimizing being an iterative process for satisfying required upper and lower bounds for gain radiation patterns of beams of said multibeam antenna; and computer program code means for optimizing the surface shapes and sizes of said reflectors, said optimizing being an iterative process for satisfying said required upper and lower bounds for said gain radiation patterns of said beams of said multibeam antenna.

28. The computer program product according to claim 27, wherein said reflectors are a pair, one reflector being a primary or main reflector illuminated by another reflector being a subreflector, which is illuminated by said feeds.

29. The computer program product according to claim 27, wherein each feed comprises a radiating element or a radiating element combined with one or more reflectors or lenses.

30. The computer program product according to claim 27, wherein said computer program code means for providing comprises:

computer program code means for determining requirements for said beam directions and gain radiation patterns;

computer program code means for specifying said reflectors and applying said initial reflector-shaping process;

computer program code means for specifying said feeds having a nominal design;

computer program code means for placing feeds at focal points; and computer program code means for calculating gain radiation patterns of beams of said multibeam antenna, said computer program code means for calculating using the methods of physical optics or the geometrical or physical theories of diffraction.

31. The computer program product according to claim 27, wherein said computer program code means for optimizing said radiation patterns of said feeds comprises computer program code means for shaping of said radiation patterns of said feeds to decrease spillover of said beams at one or more of said reflectors of said multibeam antenna.

32. The computer program product according to claim 27, wherein said computer program code means for optimizing said radiation patterns of said feeds comprises computer program code means for shaping said radiation patterns of said feeds to compensate for distorting effects of said reflectors on shapes of said beams or to increase rotational symmetry of said beams at one or more reflectors of said multibeam antenna.

33. The computer program product according to claim 27, wherein said computer program code means for optimizing said surface shapes and sizes of said reflectors comprises computer program code means for optimizing said reflectors to increase rotational symmetry or decrease spillover of said beams at one or more of said reflectors of said multibeam antenna.

34. The computer program product according to claim 27, wherein said computer program code means for optimizing comprises computer program code means for representing said sizes or shapes of said feeds or said reflectors in terms of a set of variable parameters and optimizing one or more of these parameters.

35. The computer program product according to claim 34, wherein said computer program code means for optimizing involves performing a gradient search for said parameters that minimize a weighted sum of gain radiation pattern errors in regard to said required upper and lower bounds for said gain radiation patterns of said beams of said multibeam antenna.

36. The computer program product according to claim 34, wherein said computer program code means for optimizing involves minimizing said sizes of said reflectors or said feeds whilst satisfying said requirements for said gain radiation patterns of said multibeam antenna.

37. The computer program product according to claim 34, wherein said computer program code means for optimizing said radiation patterns of said feeds comprises:

computer program code means of parameterizing a profile of a horn feed; and computer program code means for applying a gradient search to minimize a maximum gain of a respective feed radiation pattern for off-axis angles exceeding a predetermined value.

38. The computer program product according to claim 27, wherein said computer program code means for optimizing perform one or more iterations to satisfy said requirements for gain patterns of said multibeam antenna.

39. The computer program product according to claim 27, wherein said computer program code means for optimizing comprises computer program code means for calculating the said gain radiation patterns of the beams of said multibeam antenna, said computer program code means for calculating using the methods of physical optics or the geometrical or physical theories of diffraction.

40. An apparatus for electromagnetically designing a shaped-reflector multibeam antenna, said apparatus comprising:

a storage unit for storing data and computer program code to be carried out by a processing unit;

a processing unit coupled to said storage unit, said processing unit being programmed with said computer program code to:

provide an initial configuration of reflectors shaped with an initial reflector shaping process and feeds for said multibeam antenna for required beam directions, said reflector shaping process being an iterative optimization process for increasing the focusing of optical rays incident on said multibeam antenna from each of said beam directions;

optimize said radiation patterns of said feeds, said optimizing being an iterative process for satisfying required upper and lower bounds for gain radiation patterns of beams of said multibeam antenna; and optimize surface shapes and sizes of said reflectors, said optimizing being an iterative process for satisfying said required upper and lower bounds for said gain radiation patterns of said beams of said multibeam antenna.

41. The apparatus according to claim 40, wherein said reflectors are a pair, one reflector being a primary or main reflector illuminated by another reflector being a subreflector, which is illuminated by said feeds.

42. The apparatus according to claim 40, wherein each feed comprises a radiating element or a radiating element combined with one or more reflectors or lenses.

43. The apparatus according to claim 40, wherein said processing unit is programmed to:

determine requirements for said beam directions and gain radiation patterns;

specify said reflectors and apply said initial reflector-shaping process;

specify said feeds having a nominal design;

place feeds at focal points; and calculate gain radiation patterns of beams of said multibeam antenna, said calculating using the methods of physical optics or the geometrical or physical theories of diffraction.

44. The apparatus according to claim 40, wherein optimizing said radiation patterns of said feeds comprises shaping of said radiation patterns of said feeds to decrease spillover of said beams at one or more of said reflectors of said multibeam antenna.

45. The apparatus according to claim 40, wherein optimizing radiation patterns of feeds comprises shaping said radiation patterns of said feeds to compensate for distorting effects of said reflectors on shapes of said beams or to increase rotational symmetry of said beams at one or more reflectors of said multibeam antenna.

46. The apparatus according to claim 40, wherein optimizing said surface shapes and sizes of said reflectors comprises optimizing said reflectors to increase rotational symmetry or decrease spillover of said beams at one or more of said reflectors of said multibeam antenna.

* * * * *